US006387198B1

(12) United States Patent
Suzuki et al.

(10) Patent No.: US 6,387,198 B1
(45) Date of Patent: May 14, 2002

(54) PROCESS FOR PRODUCING ALUMINUM ALLOY SUBSTRATE FOR LITHOGRAPHIC PRINTING PLATE

(75) Inventors: Hideki Suzuki; Yasuhisa Nishikawa, both of Shizuoka; Tomohide Yamagishi; Kazumitsu Mizushima, both of Inazawa; Hirokazu Sawada; Hirokazu Sakaki, both of Shizuoka, all of (JP)

(73) Assignees: Nippon Light Metal Co., Ltd., Tokyo; Fuji Photo Film Co., Ltd., Minami-Ashigara, both of (JP)

( * ) Notice: Subject to any disclaimer, the term of this patent is extended or adjusted under 35 U.S.C. 154(b) by 0 days.

(21) Appl. No.: 09/245,237

(22) Filed: Feb. 5, 1999

(30) Foreign Application Priority Data

Mar. 9, 1998 (JP) ..... 10-056733

(51) Int. Cl.[7] ..... C22F 1/04
(52) U.S. Cl. ..... 148/692; 148/552
(58) Field of Search ..... 148/696, 552, 148/692

(56) References Cited

U.S. PATENT DOCUMENTS 5,562,784 A 10/1996 Nishikawa et al.

FOREIGN PATENT DOCUMENTS

| | | | |
|---|---|---|---|
| JP | 61-201747 | | 9/1986 |
| JP | 62-148295 | | 7/1987 |
| JP | 4-19293 | | 3/1992 |
| JP | 5-28197 | | 4/1993 |
| JP | 6-218495 | | 8/1994 |
| JP | 7-124609 | | 5/1995 |
| JP | 07-197162 | * | 8/1995 |
| JP | 7-224339 | | 8/1995 |
| JP | 8-179496 | | 7/1996 |
| JP | 8-311591 | | 11/1996 |
| JP | 10-306355 | | 11/1998 |

* cited by examiner

*Primary Examiner*—George Wyszomierski
*Assistant Examiner*—Janelle Combs-Morillo
(74) *Attorney, Agent, or Firm*—J. Harold Nissen; Lackenback Siegel LLP

(57) ABSTRACT

In order to produce an aluminum alloy substrate for a lithographic printing plate wherein grain structure refining and homogenizing are promoted, and the uniformity of the appearance of the grained surface is particularly improved, the process of the present invention comprises the steps of: homogenizing an aluminum alloy ingot comprising 0.10 to 0.40 wt % of Fe, 0.03 to 0.30 wt % of Si, 0.004 to 0.050 wt % of Cu, 0.01 to 0.05 wt % of Ti, 0.0001 to 0.02 wt % of B and the balance of Al and unavoidable impurities, at temperatures of 350 to 480° C., successively hot-rolling the ingot with a plurality of passes in such a manner that the aluminum alloy is not recrystallized prior to the hot rolling of the final pass and recrystallized at least in the surface layer of the hot-rolled plate by only the hot rolling thereof to form a recrystallized structure having an average recrystallized grain size of less than 50 $\mu$m in a direction normal to the rolling direction, and cold-rolling the hot-rolled plate. The reduction of the plate in the hot rolling of the final pass is desirably at least 55%.

1 Claim, No Drawings

PROCESS FOR PRODUCING ALUMINUM ALLOY SUBSTRATE FOR LITHOGRAPHIC PRINTING PLATE

BACKGROUND OF THE INVENTION

1. Field of the Invention

The present invention relates to a process for producing an aluminum alloy substrate for a lithographic printing plate which has a necessary strength and a uniform grainable surface, and which shows, after graining, substantially no streak patterns formed by streaks, etc., and a uniform appearance.

2. Description of the Related Art

Generally, an aluminum alloy sheet 0.1 to 0.5 mm thick (JIS 1050, etc.) has been used as an aluminum alloy substrate for a lithographic printing plate. Such an aluminum alloy sheet has usually been produced by scalping an ingot obtained by semicontinuous casting so that the surface portion is removed, homogenizing the scalped ingot, hot-rolling the homogenized ingot, cold-rolling the hot-rolled plate, intermediate-annealing the cold-rolled plate, and finally cold-rolling the annealed plate.

The aluminum alloy substrate for a lithographic printing plate thus produced is grained by either one of or a combination of at least two of the following steps: a mechanical step, a chemical step and an electrochemical step. The grained aluminum alloy substrate is further anodized, and optionally subjected to hydrophilic treatment to give a lithographic printing plate support. The substrate is further coated with a photosensitive material to form a photosensitive layer, and is optionally subjected to a heating-burning treatment so that the photosensitive layer is strengthened, to give a photosensitive lithographic printing plate.

The lithographic printing plate is then successively subjected to treatment for producing a printing plate such as image exposure, development, water washing and lacquering to give a printing original plate. The photosensitive layer remaining still undissolved after the development is water repellent, and forms image areas as an ink-accepting portion which selectively accepts ink alone; the surface of the aluminum alloy support under the photosensitive layer is exposed in the portion where the photosensitive layer is dissolved, and the portion forms nonimage areas as a water-accepting portion due to its hydrophilic property. In development, the quality of the development is judged by visually observing the developed surface. Accordingly, an aluminum alloy substrate having a highly uniform surface which does not hinder the visual judgment is required.

When printing is to be carried out, both end portions of the printing original plate are bent, gripped in the original plate fixtures of the printing drum of a printer, and fixed. Accordingly, the substrate for a lithographic printing plate must be excellent in bendability and mountability on a printing drum, and hardly forms cracks in the bent portion during printing.

When dampening water is supplied to the original plate which is fixed as explained above, the water is held in nonimage areas alone where the photosensitive layer is removed and a hydrophilic alloy substrate surface is exposed, and it is not held in image areas where a water repellent photosensitive layer surface remains. When ink is supplied to the original plate surface in such a state, the ink adheres to the image areas alone, and is held there. The ink adhering to and being held in the image areas is further transferred to a bracket drum, and then it is transferred to a surface to be printed such as a paper sheet surface from the bracket drum, whereby printing is conducted.

Sometimes the number of prints is as many as 100,000, for example. The lithographic printing plate support must have a property of resisting transferring as many times as mentioned above, namely, resistance to printing. At the same time, the original plate must not form cracks in a bent portion as explained above, and the original plate used after burning must have a high proof stress and must not be shifted from a printing drum. Moreover, the original plate must have a water retention property for sufficiently holding dampening water so that ink does not adhere to nonimage areas. Furthermore, when pitting corrosion is produced in nonimage areas with dampening water, ink adheres to the nonimage areas during printing, which results in scumming or tinting of printed materials. Accordingly, in order to prevent scumming or tinting during printing, it is important to ensure corrosion resistance as well as water retention of the original plate. In order to ensure these properties, it is necessary to obtain an excellent uniformity of the grained surface, by graining treatment such as electrochemical treatment, and resistance to corrosion and a defectless anodic oxide film of the support.

Japanese Examined Patent Publication (Kokoku) No. 5-28197 discloses a process for producing an aluminum alloy substrate for a lithographic printing plate which shows less scumming or tinting, comprising the steps of: holding an ingot, as a homogenizing treatment, at temperature of 460 to 600° C., desirably 520 to 600° C. for at least 1 hour, hot-rolling the ingot with at least several rolling passes so that recrystallization and precipitation are repeated, the hot rolling being completed at temperatures of at least 300° C., and cold-rolling the hot-rolled plate while the cold-rolled plate is intermediate-annealed during cold rolling by heating the plate to a selected temperature of 400 to 600° C. and rapidly cooling the plate at a rate of at least 500° C./sec so that precipitation of metallic Si is inhibited.

Japanese Unexamined Patent Publication (Kokai) No. 8-179496 discloses a process for producing an aluminum alloy substrate for a lithographic printing plate excellent in visible image formability in exposure and development, wherein homogenizing is conducted at temperatures of 500 to 600° C., rough hot-rolling is started at a temperature of 430 to 480° C., hot rolling is repeated with a plurality of passes so that dynamic recrystallization is caused, rough hot rolling is finished at a temperature of 380 to 430° C. to give a plate having a thickness of 10 to 35 mm, and finish hot-rolling is completed at a temperature of 260 to 350° C. to form a fine recrystallized structure.

Japanese Unexamined Patent Publication (Kokai) No. 62-148295 discloses a process for producing an aluminum alloy substrate for a lithographic printing plate, comprising the following procedures: an aluminum alloy is homogenized at temperatures of 500 to 600° C. for at least 3 hours, and cooled to a temperature up to 430° C. at a rate up to 50° C./h or the alloy is held at temperatures of 350 to 450° C. for at least 30 minutes, so that precipitation of metallic Si is inhibited by precipitating Si contained in the alloy as Al—Fe—Si compounds and the occurrence of scumming or tinting is decreased; the alloy is hot-rolled at temperatures of 450 to 200° C. to prevent the recrystallized grains from becoming as coarse as at least 100 $\mu$m among passes and to inhibit the formation of streak patterns. In addition, the intermediate annealing subsequent to hot rolling is conducted by holding the plate at temperatures of 350 to 500° C. for 2 to 5 hours, or passing the plate through a temperature region of 400 to 550° C. in a continuous annealing furnace for a time up to 120 sec.

Japanese Unexamined Patent Publication (Kokai) No. 61-201747 discloses a process for producing an aluminum alloy substrate for a lithographic printing plate wherein the core region of the substrate is made a stripe-like rolled structure to decrease the strength lowering of the photosensitive layer subsequent to burning, by starting hot rolling at a temperature of 480 to 550° C., and finishing hot rolling at a temperature of at least 320° C. so that the hot-rolled plate has a thickness of 2.5 to 3.5 mm.

Any of the conventional technologies mentioned above form a fine and uniform grain structure in the substrate by repeating recrystallization during hot rolling.

In particular, the support for a lithographic printing plate has been required to have uniformity in appearance where no streak patterns such as streaks are substantially observed, so that a uniform grained surface can be obtained by electrochemical graining and the quality of the support can be surely judged when development is conducted after exposure.

The substrates for lithographic printing plates have been required to have still higher quality in recent years, and the grainable surface of the substrates is particularly required to have a still higher uniformity in appearance.

However, there have been limitations on refining and homogenizing the grain structure in the conventional technologies as mentioned above, and it has been difficult to improve the uniformity in appearance of the grainable surface.

SUMMARY OF THE INVENTION

An object of the present invention is to provide a process for producing an aluminum alloy substrate for a lithographic printing plate overcoming the limitations of the prior art as mentioned above, accelerating refining and homogenizing the grain structure, and particularly improving the uniformity in appearance of the grainable surface.

In order to achieve the object as mentioned above, the present invention provides a process for producing an aluminum alloy substrate for a lithographic printing plate, comprising the steps of:

preparing an aluminum alloy ingot comprising 0.10 to 0.40 wt % of Fe, 0.03 to 0.30 wt % of Si, 0.004 to 0.050 wt % of Cu, 0.01 to 0.05 wt % of Ti, 0.0001 to 0.02 wt % of B and the balance of Al and unavoidable impurities, homogenizing the ingot at temperatures of 350 to 480° C., subsequently hot-rolling the ingot in a plurality of passes to form a hot-rolled plate in such a manner that the aluminum alloy is not recrystallized prior to a final pass of said plurality of passes and is recrystallized at least in the surface layer of the hot-rolled plate, and only in the final pass, to form a recrystallized structure having an average recrystallized grain size of less than 50 $\mu$m in a direction normal to the rolling direction, and cold-rolling the hot-rolled plate.

DESCRIPTION OF THE PREFERRED EMBODIMENTS

The reduction of hot-rolling in the final pass is desirably at least 55%.

The maximum recrystallized grain size of the recrystallized structure in a direction normal to the rolling direction is desirably less than 100 $\mu$m.

One of the features of the process according to the present invention is to homogenize the ingot at temperatures of 350 to 480° C. which are lower than before. The homogenizing treatment of the ingot uniformly precipitates those alloying elements which have been dissolved in supersaturation during casting, as fine intermetallic compounds. The uniformly dispersed fine precipitates have the pinning effect of trapping dislocations introduced by hot rolling, and act to prevent or delay progress of the recovery and recrystallization step which takes place among passes in the course of hot rolling. The pinning effect of dislocations brought about by the uniform dispersion of fine precipitates also promotes uniform refining of the recrystallized grain structure in the surface layer of the plate after hot rolling of the final pass.

Another feature of the process according to the present invention is not to cause recrystallization substantially in the course of hot rolling, and to cause recrystallization only after the final pass. Recrystallization realized in a common aluminum alloy in a conventional hot rolling step is substantially static recrystallization taking place between rolling passes. The uniformly dispersed fine precipitates as explained above effectively prevent realization of recrystallization between passes. As a result, work strain introduced into the material during the entire hot rolling step is accumulated and held after the final pass. The material in such a state realizes recrystallization all at once after the final pass, and an extremely fine and highly uniform recrystallized grain structure is formed.

Recrystallization of the material has heretofore been rather positively realized in the course of hot rolling, and it has been repeated in each pass to form a uniform and fine recrystallized grain structure finally. However, the procedure has been incapable of preventing formation of streaks or streak patterns to such a degree that the product meets the recent requirement for high quality. Reasons for the lack of prevention are considered to be as explained below.

That is, causing recrystallization of the material in each of the passes results in annihilating work strain introduced into the material in the pass by the recrystallization. A large strain is, therefore, never formed. Although strain introduced into the material by rolling is macroscopically uniform, it is nonuniform when the strain is microscopically observed or when strain of individual grains is observed. The strain amount differs from region to region of the order of a grain. Accordingly, even when a macroscopic strain amount enough for sufficiently causing recrystallization of the material has been imparted thereto, there may remain some microscopic regions, of the order of a grain, which have not suffered strain necessary for recrystallizing the material. Moreover, since micro-segregation is formed in the ingot during casting, there are the following regions here and there within the material: regions where the recrystallization temperature is high, that is, regions where realization of recrystallization requires a large strain; and regions where the strength is high and deformation of the material is difficult compared with the peripheral regions, that is, regions where strain is difficult to introduce. The presence of such regions where the nonuniformity of microscopic strain and the nonuniformity of material structure are superimposed realizes coarse recrystallized grains and fine recrystallized grains after hot rolling of the final pass to form a nonuniform recrystallized structure remaining, after cold rolling, as streaks or streak patterns which are elongated in the rolling direction and are large, and whose widths in a direction normal to the rolling direction are irregular.

In the process of the present invention, recrystallization is not caused substantially in the course of hot rolling, and work strain introduced in every pass is not annihilated and accumulated and held until after the final pass, whereby a large strain can be formed. Even when there are nonuniformity of microscopic strain and nonuniformity of the material structure as explained above, strain in an amount sufficient for realizing uniform and fine recrystallization in every region, particularly in the surface layer of the hot-rolled plate can be imparted to the plate. Accordingly, a uniform and fine recrystallized grain structure can be obtained, and streaks or streak patterns can be remarkably decreased.

According to the present invention, realization of the recrystallization among passes in hot rolling can be prevented by uniformly dispersing fine precipitates as explained above. Therefore, the hot rolling step itself is not specifically required to be altered, and a conventional hot rolling step is satisfactory. Although the hot rolling must be regulated so that a time from pass to pass does not become excessively long, it is sufficient to conventionally regulate the hot rolling to such a degree that the material temperature is ensured. There is no necessity to substantially increase regulation points.

As explained above, in the present invention, an ingot is homogenized at temperatures lower than those in conventional procedures to uniformly disperse fine intermetallic compounds. The ingot in such a state is hot rolled, and realization of recrystallization which has conventionally been utilized positively is prevented. Conversely recrystallization is caused all at once in the final pass. Consequently, an extremely fine and uniform recrystallized grain structure having an average grain size less than 50 $\mu$m in a direction normal to the rolling direction can be easily obtained particularly in the surface layer of the hot-rolled plate. An aluminum alloy substrate for a lithographic printing plate having an extremely high uniformity in appearance of the grainable surface can be produced by conventionally cold-rolling the hot-rolled plate.

The chemical composition of the aluminum alloy in the present invention is restricted for reasons as explained below.

The Fe content is defined to be from 0.10 to 0.40 wt %.

Fe is an element necessary for refining grains of the cast structure in addition to forming Al—Fe-based and Al—Fe—Si-based intermetallic compounds and imparting a strength to the substrate. When the Fe content exceeds 0.40 wt%, Al—Fe-based and Al—Fe—Si-based coarse compounds are formed, and the local nonuniformity of chemical properties becomes significant. As a result, the pit shapes on the electrochemically grained surface become nonuniform. When the Fe content becomes less than 0.10 wt %, the effect of refining grains of the cast structure cannot be obtained, and the uniformity in appearance of the electrochemically grained surface is reduced by the presence of coarse grains. Furthermore, Fe is usually an element contained in an aluminum alloy as an impurity, and the production cost of the substrate rises when the Fe content is defined to be less than 0.10 wt %.

The Si content is defined to be from 0.03 to 0.30 wt %.

Si is an element necessary for forming Al—Fe—Si-based intermetallic compounds and imparting strength to the substrate. When the Si content is less than 0.03 wt %, the effect becomes insufficient. On the other hand, when the Si content exceeds 0.30 wt %, coarse Al—Fe—Si-based intermetallic compounds are formed, and the local nonuniformity of the electrochemical properties of the substrate becomes significant. Consequently, the pit shapes of the electrochemically grained surface become nonuniform. Moreover, metallic Si is formed to unpreferably promote scumming or tinting in nonimage areas. Furthermore, Si is an element usually contained in an aluminum alloy as an impurity. When the Si content is defined to be less than 0.03 wt %, the production cost of the substrate rises.

The Cu content is defined to be from 0.004 to 0.05 wt %. Cu is an element which greatly influences electrochemical graining. When the Cu content is less than 0.004 wt %, the pit density on the electrochemically grained surface becomes high. As a result, the pit size becomes excessively small, or the pits are strained. On the other hand, when the Cu content exceeds 0.05 wt %, the pit density on the electrochemically grained surface lowers. As a result, the pit size becomes excessively large or unetched regions (ungrained portions) remain. Consequently, the water retention of nonimage areas is reduced, and sucmming or tinting of the plate increases during printing.

The Ti content is defined to be from 0.010 to 0.050 wt %.

Ti is effective in refining the grains of the cast structure. Therefore, Ti is useful for preventing crack formation during casting, and effective in preventing streak formation on the grainable surface caused by grain coarsening of the cast structure. Moreover, Ti is an element greatly influencing electrochemical graining. When the Ti content is less than 0.010 wt %, the effect of refining the grains of the cast structure is insignificant, and the pit density on the electrochemically grained surface is lowered, whereby a uniform grained surface cannot be obtained. On the other hand, when the Ti content exceeds 0.050 wt %, not only the effect of refining grains of the cast structure is saturated, but also Al—Ti-based coarse compounds are formed conversely, whereby the grains of the cast structure become nonuniform. Moreover, since the pit density on the electrochemically grained surface becomes excessively high, the pit shapes are strained, and the grained surface becomes of general dissolution. As a result, the water retention of nonimage areas is reduced, and scumming or tinting during printing increases.

The B content is defined to be from 0.0001 to 0.020 wt %.

B is added together with Ti, and is effective in refining grains of the cast structure. The effect is more significant compared with that of adding Ti alone. When the B content is less than 0.0001 wt %, the effect is insignificant. On the other hand, when the B content exceeds 0.020 wt %, not only the effect of refining grains of the cast structure is saturated, but also Ti—B-based coarse compounds are formed conversely, whereby the grains of the cast structure become nonuniform. As a result, the pit shapes are strained, and the water retention of the nonimage areas is reduced, whereby scumming or tinting increases during printing.

The Al alloy sometimes contains elements such as Mg, Mn, Cr, Zr, V, Zn, Ni, Ga, Li and Be as impurities. When the content of each element is as small as up to about 0.05 wt %, no significant effect is exerted on the results of the present invention.

In the present invention, the recrystallized grain structure in the surface layer of the hot-rolled plate is regulated as explained below.

A melt of an aluminum alloy having a chemical composition as mentioned above and prepared by a slag-off procedure, and the like, is conventionally cast into an ingot. Although there is no specific limitation on the casting method, semicontinuous casting is desirable. Although there is no specific limitation on the thickness of the ingot, the thickness is usually from about 500 to 600 mm.

When the ingot is scalped, it is homogenized by holding it at temperatures of 350 to 480° C. A holding time of about 30 minutes to 12 hours is suitable for the homogenizing treatment. As described above, one of the features of the present invention is that the homogenizing treatment is conducted at low temperature, compared with the conventional one. During the low temperature homogenizing treatment, those alloying elements which are dissolved in supersaturation during casting form uniform and fine precipitates as intermetallic compounds. The precipitates prevent realization of recrystallization in the course of the subsequent hot rolling by the pinning effect of trapping dislocations introduced by working in the hot-rolling step. When the homogenizing temperature is lower than 350° C., precipitation of the intermetallic compounds becomes insufficient. On the other hand, when the homogenizing temperature exceeds 480° C., the intermetallic compounds having been precipitated redissolve during heating, and the fine intermetallic compounds effective in trapping dislocations are decreased, whereby realization of the recrystallization in the course of hot rolling cannot be surely prevented. Therefore, it becomes impossible to cause recrystallization in the final pass alone and, as a result, to form a fine recrystallized grain structure in the surface layer of the hot-rolled plate. When the holding time for the homogenizing treatment is less than 30 minutes, precipitation of the intermetallic compounds is not sufficient. On the other hand, when the holding time exceeds 12 hours, the precipitated particles have the possibility of being redissolved even at holding temperatures in the range of the present invention if the temperatures are on the high temperature side, and the production cost increases. Since the homogenizing treatment is carried out at lower temperature in the process of the present invention than in a conventional process as explained above, the present invention is also favorable to energy saving.

After the homogenizing treatment, the ingot is hot-rolled generally in at least several rolling passes. In the present invention, it is essential that recrystallization of the hot-rolled plate is not realized in the course of hot rolling. In order to achieve the object, the presence of fine precipitates formed by homogenizing treatment is important. The fine precipitates delay realizing the recrystallization because they trap or pin dislocations introduced into the hot-rolled plate as work strain of hot rolling and prevent the start and progress of the recovery and recrystallization process. As explained above, a uniform and fine recrystallized grain structure is formed in the surface layer of the hot-rolled plate by preventing the realization of recrystallization in the hot-rolled plate in the course of hot rolling so that the work strain is accumulated and held until after the end of the final pass, and realizing the recrystallization all at once after the final pass.

Hot-rolling an ingot can be started immediately after homogenizing it, or after homogenizing, scalping, and then reheating it to a selected temperature. In the present invention, in order to regulate the structure of the aluminum alloy among passes of hot rolling and after finishing hot rolling, regulation of the homogenizing conditions is essential. Moreover, when the hot rolling starting temperature and finishing temperature are regulated, the substrate of the present invention can be easily produced.

The hot rolling starting temperature is desirably from 300 to 480° C. When the hot rolling starting temperature is lower than 300° C., stabilized hot rolling is difficult due to a high resistance to rolling. On the other hand, when the hot rolling starting temperature exceeds 480° C., recrystallization of the rolled plate tends to be realized among passes at a usual hot rolling rate. Moreover, the recrystallized grains tend to grow, and the work strain is relieved. As a result, it becomes difficult to realize the recrystallization all at once by accumulating and holding the work strain until after the final pass. In particular, it becomes difficult to form a uniform and fine recrystallized grain structure in the surface layer of the hot-rolled plate, and coarse recrystallized grains tend to be formed.

The hot rolling finishing temperature is desirably from 200 to 380° C. Moreover, the plate thickness at the end of hot rolling is desirably from 2 to 10 mm. When the hot rolling finishing temperature and the finishing thickness are regulated to the ranges as mentioned above, the hot-rolled plate subsequent to the final pass is not required to be particularly heated and heat-retained. The hot-rolled plate is simply allowed to cool, and recrystallization in the plate can be easily caused with the waste heat of the plate material itself. A plate thickness convenient for cold rolling in the subsequent step is thus obtained. A plate thickness of 3.5 to 7 mm at the time of finishing hot rolling is more desirable.

The reduction by hot rolling in the final pass is desirably at least 55%. Since recrystallization of the hot-rolled plate is realized after the final pass in the present invention, the work strain caused by the final pass most significantly influences the recrystallization. Accordingly, imparting a large work strain to the plate by the final pass with such a reduction as mentioned above is very favorable to finally forming a uniform and fine recrystallized structure in the surface layer of the hot-rolled plate. That is, when the plate is hot rolled with a reduction of at least 55% in the final pass, an average recrystallized grain size of less than 50 $\mu$m and a maximum grain size of less than 100 $\mu$m can be easily obtained in a direction normal to the rolling direction at least in the surface layer of the hot-rolled plate.

Although the surface layer of the hot-rolled plate in the present invention designates a region having a depth up to about 800 $\mu$m from the plate surface when the plate has a thickness up to 10 mm, a depth to be removed by etching during electrochemical graining is taken into consideration in determining the region. That is, the hot-rolled plate is cold-rolled to give an alloy substrate having a final thickness of about 0.15 to 0.5 mm, and the cold-rolled plate is electrochemically grained so that a surface portion about 10 to 20 $\mu$m thick is removed by etching. As a result, a plane of the initial substrate having been situated at the depth to which the substrate surface portion is removed by etching is exposed as a final grained surface. The surface portion of the hot-rolled plate is determined in the following manner: the etching removal depth of the substrate is converted to the depth from the surface of the hot-rolled plate, and the thickness is considered to some extent so that the irregularities of the grained surface are fully included. As a typical example, for a hot-rolled plate having a thickness of 2 to 10 mm, the surface layer designates a region having a depth of 200 to 800 $\mu$m.

Since the recrystallized grain size in the surface layer, as mentioned above, does not change substantially in the thickness direction when the hot-rolled plate has a thickness up to 10 mm, an evaluation of the recrystallized grain size in the surface layer of the hot-rolled plate can be made by measuring the recrystallized grain size on the surface of the hot-rolled plate.

In the present invention, the hot-rolled plate is satisfactory when at least the surface layer thereof is formed with a uniform and fine recrystallized grain structure. That is, whether or not the core portion of the hot-rolled plate is composed of a uniform and fine recrystallized structure is out of the question for reasons as explained below. Streaks or streak patterns on the lithographic printing plate support are manifested by electrochemical graining, and the core portion of the plate is not directly related to the formation of the streaks or streak patterns.

Whether or not recrystallization in the plate has taken place in the course of hot rolling can be easily judged by observing the structure of the material immediately before hot-rolling of the final pass. When recrystallization has not taken place in the course of hot rolling, grains of the cast structure become a fibrous worked structure elongated in the rolling direction. Conversely, when recrystallization takes place in the course of hot rolling, the fibrous worked structure having been formed before the recrystallization disappears. As a result, the elongation of the worked structure is small compared with that of the worked structure in which recrystallization has not taken place in the course of hot rolling, or the worked structure has disappeared.

One of the features of the mechanical properties of the aluminum alloy substrate according to the present invention is that work hardening of the plate caused by cold rolling is small. In the present invention, Fe dissolved in the ingot in supersaturation during casting forms many fine precipitates as intermetallic compounds by homogenizing at temperatures of 350 to 480° C. which are low compared with conventional homogenizing ones, and as a result the amount of dissolved Fe is decreased. Accordingly, even when intermediate annealing and final annealing are not conducted in the step of cold-rolling the hot rolled plate, marked work hardening of the plate does not take place, and the tensile strength of the cold-rolled plate does not become significantly high. Therefore, even when cold rolling is conducted while intermediate annealing and final annealing are omitted, crack formation of the support in the mounted portion on a printing drum and the bent portion during printing is decreased because the support is excellent in mountability on the printing drum and bendability, and the resistance to printing of the support is thus improved.

In conventional procedures, since the homogenizing temperature is high, fine precipitates are not present. As a result, there is no decrease in an amount of dissolved Fe due to precipitation of Fe. Omission of intermediate annealing or final annealing in the cold rolling, therefore, results in a high tensile strength of the substrate. Accordingly, the substrate as a support shows decreased mountability on a printing drum and decreased bendability, and cracks tend to be formed in the mounted portion and bent portion during printing, which lowers the resistance to printing of the printing plate. It has, therefore, been impossible to omit intermediate annealing in the cold rolling step.

As explained above, an aluminum alloy substrate for a lithographic printing plate is produced by the steps of casting, scalping, homogenizing, hot rolling and cold rolling in the present invention. However, intermediate annealing in the course of cold rolling and/or final annealing after finishing cold rolling can also be conducted, if necessary. Moreover, leveling with a leveler for improving the flatness of the substrate can also be conducted after finishing cold rolling.

Intermediate annealing in the course of cold rolling or final annealing can be conducted, if necessary. The annealing procedure can be either batch annealing or continuous annealing.

Batch annealing is typically conducted at temperatures of 200 to 600° C. for a holding time of 1 to 24 hours. When the holding temperatures are lower than 200° C., the annealing effect of removing work hardening caused by cold rolling is insufficient. When the holding temperatures exceed 600° C., the recrystallized grains are coarsened, and a grained surface having a high uniformity in appearance cannot be obtained by an electrochemical procedure. Moreover, the mechanical properties are also deteriorated, and a good resistance to printing cannot be obtained. When the holding time is less than 1 hour, the annealing effect of removing work hardening is insufficient. When the holding time exceeds 24 hours, the annealing effect is saturated, and the process simply becomes uneconomical.

Typically, using a continuous annealing apparatus, continuous annealing is conducted by heating the cold-rolled plate to a temperature of 350 to 600° C. at a heating rate of at least 1° C./sec, and cooling the plate to a temperature up to 100° C. at a cooling rate of at least 1° C./sec, desirably at least 500° C./sec by water cooling, when the plate is heated to a selected temperature. Although there is no specific limitation on the continuous annealing apparatus, a transverse flux induction heating system the heating method of which utilizes the heat generation of the aluminum alloy itself is desirable because the amount of oxide film formation on the aluminum alloy plate surface is small and adverse effects on the plate surface are insignificant.

EXAMPLES

Example 1

Aluminum alloy melts each having a chemical composition as shown in Table 1 were prepared. In Table 1, alloys A to H each had a chemical composition in the range of the present invention, and alloys I to L each had a chemical composition outside the range of the present invention.

Each of the aluminum alloy melts was semicontinuous-cast to give an ingot having a thickness of 560 mm. Both surfaces of the ingot were scalped so that the thickness was decreased by 10 mm per side and the ingot had a thickness of 540 mm.

The ingot was homogenized for 4 hours, and hot-rolled with a reversing rolling mill to give a hot-rolled plate having a thickness of 6 mm. The plate was hot-rolled with a number of passes of 15, and a time between a pass and the following pass was in the range from 10 sec to 1.5 minutes. Table 2 shows the homogenizing temperature, the starting and finishing temperatures of hot rolling and the reduction in the final pass. In Table 2, the conditions of homogenizing treatment and hot rolling of each of the sample Nos. 1 to 5 were within the scope of the present invention. At least one of the conditions was outside the scope of the present invention when each of the sample Nos. 6 to 12 was prepared.

Each of the hot-rolled plates was subsequently cold rolled to give a cold rolled plate having a thickness of 0.24 mm as a substrate.

For each of the alloy substrates in examples (sample Nos. 1 to 5) and comparative examples (sample Nos. 6 to 12) obtained under the production conditions shown in Table 2, measurements of a recrystallized grain size in the surface layer of a hot-rolled plate, uniformity in pit shapes and uniformity in appearance of the electrochemically grained surface, a dissolved amount of Fe, a tensile strength and a proof stress subsequent to burning treatment of the cold-rolled plate were made, and the results are also shown in Table 2. The measurements were made as explained below.

(1) Recrystallized Grain Size in Surface Layer of Hot-rolled Plate

A surface of a hot-rolled plate was mirror-finished, and anodized with a Barker's solution (solution containing 11 ml of tetrafluoroboric acid per liter). The grains were observed with a polarizing microscope, and the grain size was measured by the linear line method in a direction normal to the rolling direction. Table 2 also shows the minimum value, the maximum value and the average value of the grain size thus obtained.

Furthermore, the grain structure of a hot-rolled plate directly before hot rolling of the final pass was observed by the same procedure as mentioned above.

(2) Uniformity in Pits on Electrochemically Grained Surface

The alloy substrates obtained by cold rolling were brush-grained in a pumice/water suspension, alkali-etched, and desmut-treated.

Thereafter, electrochemical graining was carried out by electrolytic etching in 1% nitric acid using a power supply providing an electrolytic waveform with alternating polarity at an anodic electricity quantity of 150 Coulomb/$dm^2$.

The treated substrates were cleaned in sulfuric acid, and the grained surface thereof was observed under a scanning electron microscope (SEM). The surface was evaluated as "good to)" when the etch pits were uniform, and "failed (x)" when many unetched portions were found or graining was nonuniform.

(3) Uniformity in Appearance of Electrochemically Grained Surface

The substrates were electrolytically grained by the same procedure as in (2), and cleaned in sulfuric acid. Then, an anodic oxide film was formed in sulfuric acid, and the grained surface of the substrates was observed with the naked eye to evaluate the uniformity in appearance. The appearance was evaluated as "good (o)" when the appearance was uniform to such a degree that the surface substantially had no streaks and streak patterns were not found, "somewhat poor (Δ)" when the appearance was not allowably uniform to such a degree that the surface had slight streaks and streak patterns were found to some extent, and "failed (x)" when the appearance was nonuniform to such a degree that the surface had many streaks and streak patterns were clearly found.

(4) Amount of Dissolved Fe

The alloy substrate obtained by cold rolling was dissolved in hot phenol, and the dissolved matrix was separated from the intermetallic compounds as a residue by filtering. Fine intermetallic compounds having passed through the filter were separated from the filtrate by extraction with a solution containing 10% of citric acid. The amount of Fe dissolved in the solution was measured as an element dissolved in the substrate by an ICP spectral analysis apparatus.

(5) Tensile Strength

A tensile test piece (JIS No. 13 B) was prepared from the alloy substrate obtained by cold rolling, and the tensile strength $\sigma_B$ was measured.

(6) Proof Stress Subsequent to Burning Treatment

The alloy substrate obtained by cold rolling was subjected to burning treatment in which the substrate was heated at 270° C. for 7 minutes. A test piece (JIS No. 13 B) was prepared from the treated substrate, and the proof stress $\sigma_{0.2}$ was measured.

In addition, in order to judge whether or not recrystallization of the plate was realized in the course of hot rolling, the structure of a hot-rolled plate 6 mm thick having been produced under the same conditions of producing any of the numbered samples in Table 2, until the step of hot rolling, was observed just before hot rolling of the final pass. As a result, it was confirmed that a hot-rolled plate produced under the same conditions of producing any of the sample Nos. 1 to 5 in examples and a hot-rolled plate produced under the same conditions of producing the sample No. 6 in comparative examples showed immediately before hot rolling of the final pass a fibrous worked structure formed with grains significantly elongated long in the rolling direction and that no recrystallization, therefore, had taken place in the hot-rolled plates in the course of hot rolling. It was confirmed that in contrast to the hot-rolled plates mentioned above, hot-rolled plates produced under the same conditions of producing the sample No. 7 or No. 8 showed immediately before hot rolling of the final pass a small elongation of the grains and that recrystallization, therefore, had taken place in the hot-rolled plates in the course of hot rolling.

It is understood from the results in Table 2 that the pit shapes on the electrochemically grained surface of the sample Nos. 9 to 12 (alloys I to L) the chemical compositions of which were outside the range of the present invention were not uniform.

Moreover, since the sample Nos. 1 to 5 in examples were not recrystallized in the course of hot rolling as explained above, the average grain sizes of the surface layer of the hot-rolled plates were less than 50 μm, and the maximum grain sizes were up to 95 μm. The hot-rolled plates thus showed a fine and uniform recrystallized grain structure. As a result, the hot-rolled plates showed no streak patterns on the electrochemically grained surface, and a good uniformity in appearance. Furthermore, since the hot-rolled plates had a low tensile strength, a good mountability on a printing drum and a good bendability could be ensured.

Furthermore, since the hot-rolled plates have a high 0.2% proof stress subsequently to burning treatment, a sufficient resistance to printing of the plates can be ensured even when a type requiring the burning treatment is employed.

The sample No. 6 in comparative examples was not recrystallized in the course of hot rolling. However, since the reduction of hot rolling of the final pass was as low as 30%, the average recrystallized grain size in the surface layer of the hot-rolled plate was as large as 150 μm. Consequently, streak patterns were clearly observed on the grained surface of the cold-rolled plate (substrate), and the uniformity in appearance could not be obtained. Furthermore, since the plate showed a high tensile strength, a good mountability on a printing drum and a good bendability of the plate could not be ensured.

Since the homogenizing temperature, and the starting and finishing temperatures of hot rolling of the sample No. 7 in comparative examples were high, recrystallization took place in the course of hot rolling, and the average recrystallized grain size in the surface layer of the hot-rolled plate was as large as 250 μm. Consequently, streak patterns were clearly observed on the grained surface of the cold-rolled plate (substrate), and the uniformity in appearance of the plate could not be obtained. Moreover, since the plate had a high tensile strength, a good mountability on a printing drum and a good bendability of the plate could not be ensured.

Since the homogenizing temperature of the sample No. 8 in comparative examples was high, recrystallization took place in the course of hot rolling, and the average recrystallized grain size in the surface layer of the hot-rolled plate was as large as 130 μm. Consequently, streak patterns were clearly observed on the grained surface of the cold-rolled plate (substrate), and the uniformity in appearance could not be obtained. Moreover, since the plate had a high tensile strength, a good mountability on a printing drum and a good bendability of the plate could not be ensured.

Since the chemical compositions of the alloys of sample Nos. 9 to 12 in comparative examples were outside the range of the present invention, the pit shapes on the electrochemically grained surface of each of the samples were nonuniform. It was, therefore, evident that the plates were not suitable as substrates. Accordingly, no measurements of the recrystallized grain structure of the hot-rolled plates, the uniformity in appearance of the grained surface, the amount of dissolved Fe, the tensile strength and the proof stress after burning treatment of the cold rolled plates (substrates) were made.

Example 2

Using the alloys A to H shown in Table 1 and each having a chemical composition within the range of the present invention, hot-rolled plates 6 mm thick were produced under the same conditions of producing the sample Nos. 1 to 8 in Example 1 as shown in Table 2, until the step of hot rolling. The hot-rolled plates were cold-rolled to give cold rolled plates having a thickness of 1 mm. The cold-rolled plates were intermediate-annealed, and finally cold-rolled to give a cold-rolled plates (substrates) having a thickness of 0.24 mm. The intermediate annealing was conducted either by batch annealing or continuous annealing. The batch annealing was conducted by heating a cold rolled plate at a temperature rise rate of 50° C./sec, held at a selected temperature for 1 hour, and air-cooled to room temperature. The continuous annealing was conducted by rapidly heating a cold-rolled plate at a temperature rise rate of 300° C./sec with a transverse flux induction system, and water-cooling the heated plate immediately after reaching a selected temperature. The conditions of the respective plate-producing steps as mentioned above are summarized in Table 3.

Measurements of the uniformity in pit shapes and the uniformity in appearance on the electrochemically grained surface, the amount of dissolved Fe, the tensile strength and the proof stress after burning treatment were made on each of the alloy substrates of sample Nos. 13 to 22 in examples and samples Nos. 23 to 28 in comparative examples obtained by plate-producing steps in Table 3 by the same procedure and conditions as in Example 1. The measurement results are also shown in Table 3.

It is seen from the results in Table 3 that since the sample Nos. 13 to 22 in examples and the sample Nos. 23 to 28 in comparative examples each had a chemical composition of alloy within the range of the present invention, the uniformity in pit shapes on the electrochemically grained surface was good.

Furthermore, conditions of producing any of the sample Nos. 13 to 22 of examples until the step of hot rolling were the same as those of producing one of the sample Nos. 1 to 5 of examples in Example 1. Since the samples were not recrystallized in the course of hot rolling, the average recrystallized grain sizes in the surface layer of the hot rolled plates were as fine as less than 50 μm, and no streak patterns were observed on the grained surface of the cold-rolled plates (substrates). A good uniformity in appearance of the plates was thus obtained. Moreover, since the tensile strength of the plates was low, a good mountability on a printing drum and a good bendability of the plates could be ensured. Furthermore, since the 0.2% proof stress of the plates subsequent to burning treatment was high, a sufficient resistance to printing can be ensured even when the plates were used for a type requiring burning treatment.

In contrast to the samples No. 13 to No. 22, conditions of producing samples No. 23 and No. 24 in comparative examples were the same as those of producing the sample No. 6 in Example 1 until the step of hot rolling. The samples No. 23 and No. 24 were not recrystallized in the course of hot rolling. However, since the reduction of hot rolling of the final pass was as low as 30%, the average recrystallized grain sizes in the surface layer of the hot-rolled plates were as large as 150 μm. As a result, streak patterns were clearly observed on the grained surface of the cold-rolled plates (substrates) though intermediate annealing had been conducted in the cold rolling step, and a good uniformity in appearance could not be obtained.

Conditions of producing the samples No. 25 and No. 26 in comparative examples were the same as those of producing the sample No. 7 in Example 1 until the step of hot rolling, and the samples were recrystallized in the course of hot rolling. Accordingly, the average recrystallized grain sizes in the surface layer of the hot rolled plates were as large as 250 μm. Streak patterns were, therefore, clearly observed on the grained surface of the cold-rolled plates (substrates) though intermediate annealing had been conducted in the cold rolling step, and a good uniformity in appearance could not be obtained.

Conditions of producing samples No. 27 and No. 28 in comparative examples were the same as those of producing the sample No. 8 in Example 1 until the step of hot rolling. Accordingly, the average recrystallized grain size in the surface layer of the hot rolled plates were as large as 130 μm. Streak patterns were, therefore, clearly observed on the grained surface of the cold-rolled plates (substrates) though intermediate annealing had been conducted in the cold rolling step, and a good uniformity in appearance could not be obtained.

TABLE 1

| | Alloy | Si | Fe | Cu | Ti | Mn | Mg | Cr | Zr | V | Zn | Ni | Ga | Li | Be | B | (wt %) Al and other impurities |
|---|---|---|---|---|---|---|---|---|---|---|---|---|---|---|---|---|---|
| Invention | A | 0.08 | 0.22 | 0.013 | 0.01 | 0.001 | 0.002 | 0.001 | 0.001 | 0.005 | 0.004 | 0.005 | 0.012 | 0.000 | 0.001 | 0.001 | Bal. |
| | B | 0.08 | 0.30 | 0.008 | 0.03 | 0.002 | 0.002 | 0.001 | 0.001 | 0.015 | 0.004 | 0.010 | 0.015 | 0.000 | 0.001 | 0.001 | Bal. |
| | C | 0.12 | 0.24 | 0.011 | 0.02 | 0.002 | 0.013 | 0.001 | 0.001 | 0.014 | 0.003 | 0.008 | 0.016 | 0.000 | 0.001 | 0.001 | Bal. |
| | D | 0.10 | 0.32 | 0.020 | 0.02 | 0.001 | 0.002 | 0.002 | 0.002 | 0.015 | 0.002 | 0.009 | 0.014 | 0.001 | 0.000 | 0.001 | Bal. |
| | E | 0.10 | 0.24 | 0.011 | 0.02 | 0.002 | 0.008 | 0.001 | 0.001 | 0.006 | 0.003 | 0.005 | 0.012 | 0.000 | 0.001 | 0.001 | Bal. |
| | F | 0.07 | 0.28 | 0.014 | 0.02 | 0.003 | 0.005 | 0.001 | 0.002 | 0.015 | 0.002 | 0.009 | 0.014 | 0.001 | 0.000 | 0.001 | Bal. |
| | G | 0.05 | 0.34 | 0.022 | 0.02 | 0.002 | 0.008 | 0.001 | 0.001 | 0.010 | 0.003 | 0.008 | 0.012 | 0.001 | 0.001 | 0.001 | Bal. |
| | H | 0.10 | 0.32 | 0.008 | 0.03 | 0.001 | 0.020 | 0.001 | 0.002 | 0.006 | 0.002 | 0.009 | 0.012 | 0.000 | 0.000 | 0.002 | Bal. |
| | I | 0.50 | 0.30 | 0.013 | 0.03 | 0.002 | 0.002 | 0.002 | 0.001 | 0.008 | 0.003 | 0.008 | 0.015 | 0.000 | 0.001 | 0.002 | Bal. |
| | J | 0.15 | 0.90 | 0.010 | 0.02 | 0.004 | 0.010 | 0.003 | 0.002 | 0.014 | 0.006 | 0.012 | 0.015 | 0.001 | 0.000 | 0.001 | Bal. |
| Comparision | K | 0.08 | 0.30 | 0.113 | 0.03 | 0.002 | 0.002 | 0.001 | 0.001 | 0.010 | 0.003 | 0.008 | 0.014 | 0.000 | 0.001 | 0.002 | Bal. |
| | L | 0.08 | 0.30 | 0.015 | 0.10 | 0.002 | 0.006 | 0.001 | 0.002 | 0.013 | 0.002 | 0.009 | 0.013 | 0.001 | 0.001 | 0.004 | Bal. |

Note: The underlined data are outside the specified range.

TABLE 2

| | Sample No. | Alloy | Homogenizing temp. (° C.) | Hot rolling Start temp. (° C.) | Hot rolling Finish temp. (° C.) | Hot rolling Reduction in final pass (%) | Grain size in surface layer of hot-rolled plate Ave. (μm) | Min. (μm) | Max. (μm) | Uniformity of electrochemically grained surface Pit shape | Appearance | Amount of Fe in solid solution (ppm) | Tensile strength $\delta_B$ (N/mm$^2$) | Proof stress after burning $\delta_{0.2}$ (N/mm$^2$) |
|---|---|---|---|---|---|---|---|---|---|---|---|---|---|---|
| Invention | 1 | A | 450 | 440 | 360 | 60 | 45 | 5 | 95 | ○ | ○ | 20 | 175 | 108 |
| | 2 | B | 400 | 380 | 350 | 60 | 35 | 5 | 90 | ○ | ○ | 20 | 166 | 106 |
| | 3 | C | 400 | 390 | 320 | 60 | 20 | 5 | 80 | ○ | ○ | 20 | 165 | 110 |
| | 4 | D | 400 | 390 | 250 | 60 | 10 | 2 | 40 | ○ | ○ | 25 | 176 | 110 |
| | 5 | E | 350 | 340 | 345 | 60 | 25 | 2 | 80 | ○ | ○ | 20 | 160 | 103 |
| Comparision | 6 | F | 400 | 390 | 350 | 30 | 150 | 30 | 250 | ○ | x | 20 | 185 | 101 |
| | 7 | G | 550 | 540 | 420 | 60 | 250 | 30 | 350 | ○ | x | 60 | 190 | 134 |
| | 8 | H | 550 | 450 | 360 | 60 | 130 | 30 | 160 | ○ | x | 50 | 189 | 132 |
| | 9 | I | 400 | 380 | 350 | 60 | — | — | — | x | — | — | — | — |
| | 10 | J | 400 | 390 | 360 | 60 | — | — | — | x | — | — | — | — |
| | 11 | K | 400 | 380 | 320 | 60 | — | — | — | x | — | — | — | — |
| | 12 | L | 400 | 390 | 350 | 60 | — | — | — | x | — | — | — | — |

TABLE 3

| | Sample No. | Alloy | Homogenizing temp. (° C.) | Hot rolling Start temp. (° C.) | Hot rolling Finish temp. (° C.) | Hot rolling Reduction in final pass (%) | Intermediate annealing during cold rolling System | Temp. (° C.) | Grain size in surface layer of hot-rolled plate Ave. | Min. | Max. | Uniformity of electrochemically grained surface Pit shape | Appearance | Amount of Fe in solid solution (ppm) | Tensile stress strength (N/mm$^2$) | Proof stress after burning (N/mm$^2$) |
|---|---|---|---|---|---|---|---|---|---|---|---|---|---|---|---|---|
| Invention | 13 | A | 450 | 440 | 360 | 60 | Batch | 540 | 45 | 5 | 95 | ○ | ○ | 55 | 150 | 132 |
| | 14 | A | 450 | 440 | 360 | 60 | Continuous | 440 | 45 | 5 | 95 | ○ | ○ | 30 | 150 | 120 |
| | 15 | B | 400 | 380 | 350 | 60 | Batch | 480 | 35 | 5 | 90 | ○ | ○ | 50 | 155 | 124 |
| | 16 | B | 400 | 380 | 350 | 60 | Continuous | 470 | 35 | 5 | 90 | ○ | ○ | 55 | 154 | 133 |
| | 17 | C | 400 | 390 | 320 | 60 | Batch | 500 | 20 | 5 | 80 | ○ | ○ | 60 | 156 | 123 |
| | 18 | C | 400 | 390 | 320 | 60 | Continuous | 480 | 20 | 5 | 80 | ○ | ○ | 50 | 155 | 129 |
| | 19 | D | 400 | 390 | 250 | 60 | Batch | 470 | 10 | 2 | 40 | ○ | ○ | 55 | 155 | 121 |
| | 20 | D | 400 | 390 | 250 | 60 | Continuous | 520 | 10 | 2 | 40 | ○ | ○ | 65 | 157 | 135 |
| | 21 | E | 350 | 340 | 345 | 60 | Batch | 500 | 25 | 2 | 80 | ○ | ○ | 55 | 152 | 124 |
| | 22 | E | 350 | 340 | 345 | 60 | Continuous | 470 | 25 | 2 | 80 | ○ | ○ | 50 | 153 | 125 |
| Comparision | 23 | F | 400 | 390 | 350 | 30 | Batch | 500 | 150 | 30 | 250 | ○ | x | 60 | 155 | 123 |
| | 24 | F | 400 | 390 | 350 | 30 | Continuous | 500 | 150 | 30 | 250 | ○ | x | 55 | 156 | 128 |
| | 25 | G | 550 | 540 | 420 | 60 | Batch | 480 | 250 | 30 | 350 | ○ | x | 55 | 157 | 123 |
| | 26 | G | 550 | 540 | 420 | 60 | Continuous | 430 | 250 | 30 | 350 | ○ | x | 30 | 157 | 126 |
| | 27 | H | 550 | 450 | 360 | 60 | Batch | 470 | 130 | 30 | 160 | ○ | Δ | 45 | 158 | 123 |
| | 28 | H | 550 | 450 | 360 | 60 | Continuous | 450 | 130 | 30 | 160 | ○ | Δ | 35 | 154 | 128 |

As explained above, according to the present invention, the recrystallized grain size in the surface layer of a hot-rolled plate can be uniformly and finely regulated by homogenizing the ingot at temperatures which are lower than those in a conventional procedure to precipitate fine intermetallic compounds, and thus preventing realization of recrystallization in the course of hot rolling so that the hot-rolled material is recrystallized all at once after hot rolling of the final pass. When the hot-rolled plate is cold-rolled by a conventional procedure, an aluminum alloy substrate for a lithographic printing plate the electrochemically grained surface of which shows uniform pit shapes, no streak patterns and uniformity in appearance can be produced.

Furthermore, since the amounts of dissolved elements (Fe in particular) of the aluminum alloy substrate of the present invention are decreased by precipitating the elements as intermetallic compounds, the substrate shows a low tensile strength. As a result, the substrate shows a good mountability on a printing drum and a good bendability. Still furthermore, since the substrate has a high proof stress after burning treatment, a sufficient resistance to printing of the substrate can be ensured even when the substrate must be subjected to burning treatment.

Homogenizing the ingot at low temperature is also advantageous from the standpoint of saving energy.

What is claimed is:

1. A process for producing an aluminum alloy substrate for a lithographic printing plate, consisting essentially of the steps of:

preparing an aluminum alloy ingot comprising 0.10 to 0.40 wt % of Fe, 0.03 to 0.30 wt % of Si, 0.004 to 0.050 wt % of Cu, 0.01 to 0.05 wt % of Ti, 0.0001 to 0.02 wt % of B and the balance of Al and unavoidable impurities, homogenizing the ingot at a temperature of 350 to 450° C., subsequently hot-rolling the ingot in a plurality of passes to form a hot-rolled plate in such a manner that the aluminum alloy is not recrystallized prior to a final pass of said plurality of passes and is recrystallized at least in a surface layer of the hot-rolled plate only in the final pass to form a recrystallized structure having an average recrystallized grain size of less than 50 $\mu$m in a direction normal to the rolling direction, wherein a reduction in said hot rolling of the final pass is at least 55%, and cold-rolling the hot-rolled plate, said recrystallized structure having a maximum recrystallized grain size of less than 100 $\mu$m in a direction normal to the rolling direction.

* * * * *